US010018938B2

(12) United States Patent
Tanaka

(10) Patent No.: US 10,018,938 B2
(45) Date of Patent: Jul. 10, 2018

(54) NETWORK SYSTEM COMPRISING CUSTOMER REPLACEABLE UNIT

(71) Applicant: Sharp Kabushiki Kaisha, Sakai, Osaka (JP)

(72) Inventor: Yuji Tanaka, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 15/364,983

(22) Filed: Nov. 30, 2016

(65) Prior Publication Data

US 2017/0082946 A1 Mar. 23, 2017

Related U.S. Application Data

(63) Continuation of application No. 11/506,082, filed on Aug. 16, 2006.

(30) Foreign Application Priority Data

Aug. 23, 2005 (JP) ..... 2005-241726

(51) Int. Cl.
*G03G 15/00* (2006.01)
*G03G 15/08* (2006.01)
*G03G 21/18* (2006.01)

(52) U.S. Cl.
CPC ..... *G03G 15/0831* (2013.01); *G03G 15/0863* (2013.01); *G03G 15/5079* (2013.01); (Continued)

(58) Field of Classification Search
CPC ..... G03G 15/0831; G03G 15/0863; G03G 15/5075; G03G 15/5079; G03G 15/553; (Continued)

(56) References Cited

U.S. PATENT DOCUMENTS 5,887,216 A * 3/1999 Motoyama ..... 399/8 X
6,363,226 B1 * 3/2002 Batori ..... G03G 21/1889 399/8 X (Continued)

OTHER PUBLICATIONS

Tanaka, "Network System Comprising Customer Replacable Unit", U.S. Appl. No. 11/506,082, filed Aug. 16, 2006.

*Primary Examiner* — Sophia S Chen
(74) *Attorney, Agent, or Firm* — Keating & Bennett, LLP

(57) ABSTRACT

A network system including a customer replaceable unit (CRU) having an excellent security function for operation information which system can realize improvement of the use efficiency of operation information for making the CRU operate, and reduction in costs, is provided. An apparatus main body of a multifunction printer, a server, a personal computer, etc. are connected to a network of a network system, and a CRU is attached to the apparatus main body so as to be detachable. Operation information necessary for making the CRU operate is stored in the server. The apparatus main body obtains operation information of the CRU from the server via the network and stores the obtained operation information into a buffer memory, and causes the CRU to operate based on the operation information. The operation information stored in the buffer memory is erased when communication between the apparatus main body and the CRU ends.

4 Claims, 5 Drawing Sheets

(52) U.S. Cl.
CPC ..... *G03G 21/1882* (2013.01); *G03G 15/553* (2013.01); *G03G 2215/00113* (2013.01); *G03G 2221/1838* (2013.01)

(58) Field of Classification Search
CPC ..... G03G 21/1882; G03G 2215/00113; G03G 2221/1838
USPC ..... 399/8, 27
See application file for complete search history.

(56) References Cited

U.S. PATENT DOCUMENTS

2002/0174104 A1* 11/2002 Yokoyama
2004/0246520 A1* 12/2004 Obert ..... G03G 15/55 358/1.15
2006/0115281 A1* 6/2006 Kim ..... G03G 15/5079 399/8

* cited by examiner

NETWORK SYSTEM COMPRISING CUSTOMER REPLACEABLE UNIT

BACKGROUND OF THE INVENTION

1. Field of the Invention

The present invention relates to a network system comprising a customer replaceable unit.

2. Description of the Related Art

In industrial equipment, office equipment and the like, as uptime accumulates, consumable articles decrease and components deteriorate. Therefore, the operator and the user sometimes need to replace the consumable articles and the components. Such replacement articles include not only a simple consumable article but also a replacement article that is replaced as a unit forming a group composed of a plurality of components or a plurality of components and consumable articles. Such a unit is called a customer replaceable unit (CRU).

For example, in an image forming apparatus that is one of the office equipment, a process cartridge, a toner cartridge, a transfer unit, a fixing unit and so on are formed as CRUs. Such a CRU is provided with a memory that is storing means (the memory provided in the CRU may be referred to as a CRUM). In the CRUM, an identification code for identifying the unit itself, a threshold value indicating a use condition, and operation information such as an operation program are stored, and moreover, operation performance of the CRU is stored after the CRU starts operation. When attached to an apparatus main body, the CRU operates based on the operation information stored in the CRUM, and stores the operation performance thereof into the CRUM.

FIG. 5 is a simplified system view illustrating the configuration of a network system 1 comprising the conventional CRU. The network system 1 illustrated in FIG. 5 has a configuration that, for example, a server 3 is connected to an in-house local area network (LAN) 2, and that a plurality of multifunction printers (MFPs) 4*a*, 4*b*, 4*c* . . . are further connected to the server 3. Here, the MFP is an image forming apparatus having a composite function of a copier, a printer, a scanner, a facsimile machine and so on. The MFP 4 (expressed without the alphabetical letters in the case of naming the MFPs generically) executes an image forming operation via the server 3 based on an operation command of an operating terminal such as a personal computer, connected to the LAN 2 (not shown).

FIG. 5 illustrates an example in which a toner cartridge is attached as a CRU 6 to an apparatus main body 5 of the MFP 4. Although the apparatus main body 5 includes an image processing portion, an image forming portion, a transfer portion, a fixing portion, a paper feeding portion and so on, only a controller 7 and a main-body central processing unit (CPU) 8 are illustrated for simplification.

In this example, the CRU 6 is a toner cartridge including, for example, a toner supply container that holds toner, a toner supply roller that is supported on the toner supply container so as to freely rotate, and so on. Moreover, the toner supply container is provided with an IC chip 9 forming a CRUM, a CPU 10 that is a processing circuit, and a connector 11 that is an electrical connection terminal with the apparatus main body 5. In the IC chip 9 provided in the CRU 6, an identification code for identifying the toner cartridge and the operation information are stored.

When attached to the apparatus main body 5, the CRU 6 is electrically connected to the apparatus main body 5 by the connector 11, whereby communication of information with the apparatus main body 5 becomes possible. When an image forming operation command is outputted from the operation terminal connected to the LAN 2, the image forming operation command is given to the controller 7 of the apparatus main body 5 via the LAN 2 and the server 3. In accordance with the image forming operation command, the main-body CPU 8 controls image forming operations of the whole MFP 4. Based on an operation command from the main-body CPU 8, the CPU 10 of the CRU 6 reads out the operation information of the toner cartridge from the IC chip 9, controls the operation of the toner cartridge that is the CRU 6 based on the operation information, and causes a developing portion provided in the image forming portion of the apparatus main body 5 to execute an operation of supplying toner. As the operation is executed, operation performance of the toner cartridge that is the CRU 6, for example, the number of rotations of the toner supply roller, which is information on the amount of remaining toner in the toner supply container, is stored in the CRUM.

In a CRU provided with a CRUM, various improvements have been proposed in order to increase convenience. For example, there is a proposal to store information on ordering into a CRUM in advance and, when a CRU reaches the limits of use through operation, provide the order information in the form of printed matter by a printing machine to make the user recognize the order information in an early stage, thereby giving the user enough time to place an order for a replacement article (for example, refer to Japanese Unexamined Patent Publication JP-A 2002-304279). Moreover, there is a proposal to store a software code upgrade into a CRUM in advance so that the operator can update a software code without the need for calling a field engineer or the like (refer to Japanese Unexamined Patent Publication JP-A 2004-1512).

However, in the case of related arts, important information such as the operation information, the order information and the software code upgrade, that is, information necessary for manufacturing a CRU is all stored in a CRUM. Therefore, when it is possible to obtain the CRU provided with the CRUM, it is possible to analyze and reproduce the information stored in the CRUM, so that there is a problem that an imitation product is easily manufactured. Moreover, there is a need to store plenty of information into the CRUM, so that there is a problem that a memory having a relatively large capacity must be disposed to each CRU, which becomes a factor in increase of the costs of the CRU.

SUMMARY OF THE INVENTION

An object of the invention is to provided a network system comprising a customer replaceable unit having an excellent security function for operation information which system can realize improvement of the use efficiency of operation information for making a customer replaceable unit operate, and reduction in costs.

The invention provides a network system comprising:

an apparatus main body having a main-body storing portion and a control portion;

a customer replaceable unit, disposed so as to be attachable to and detachable from the apparatus main body;

a server for storing operation information of the customer replaceable unit, and a communications network to which the apparatus main body and the server are connected, wherein the apparatus main body obtains the operation information of the customer replaceable unit from the server via the communications network and stores the obtained operation information into the main-body storing portion, and the control portion of the apparatus main body causes the customer replaceable unit to operate based on the operation information stored in the main-body storing portion.

According to the invention, in the network system comprising the customer replaceable unit, the apparatus main body obtains operation information of the customer replaceable unit from the server via the communications network and stores the obtained operation information into the main-body storing portion, and the control portion of the apparatus main body causes the customer replaceable unit to operate based on the operation information stored in the main-body storing portion. Consequently, the need for providing each customer replaceable unit with the operation information such as an operation program and an operation condition is eliminated, with the result that it is possible to reduce the capacity of a unit storing portion disposed to the customer replaceable unit, and it is possible to contribute to reduction in costs. Moreover, since important operation information is not stored in the customer replaceable unit, it is impossible to elicit the operation information from the customer replaceable unit, and it is possible to prevent manufacture of an imitation product using the operation information.

Further, in the invention, it is preferable that the apparatus main body further includes information erasing means for erasing the information stored in the main-body storing portion, a main-body communicating portion that communicates with the customer replaceable unit, and a communication end detecting portion that detects an end of communication between the main-body communicating portion and the customer replaceable unit, the customer replaceable unit includes a unit communicating portion that communicates with the apparatus main body; and in response to a detection result of the end of communication between the main-body communicating portion and the unit communicating portion by the communication end detecting portion, the operation information of the customer replaceable unit stored in the main-body storing portion is erased by the information erasing means.

According to the invention, in response to the detection result of the end of communication between the main-body communicating portion and the unit communicating portion by the communication end detecting portion, that is, when an operation of the apparatus main body and the customer replaceable unit based on information communication ends, the operation information of the customer replaceable unit stored in the main-body storing portion is erased by the information erasing means. Consequently, the operation information necessary for the operation of the customer replaceable unit does not remain in either the apparatus main body or the customer replaceable unit, but remains only in the server. Therefore, it is possible to prevent information leakage, and exhibit a high security function.

Furthermore, in the invention, it is preferable that communication between the main-body communicating portion of the apparatus main body and the unit communicating portion of the customer replaceable unit is executed by wireless.

According to the invention, communication between the main-body communicating portion of the apparatus main body and the unit communicating portion of the customer replaceable unit is executed by wireless. Therefore, it is not necessary to prepare wiring installation, and it is possible to simplify the configuration of the apparatus.

Still further, in the invention, it is preferable that a plurality of apparatus main bodies are connected to the communications network, the operation information of the customer replaceable unit stored in the server is transmitted to the plurality of apparatus main bodies from the server via the communications network, and operation performance information of the customer replaceable unit operated in accordance with the operation information stored in the main-body storing portion of each of the apparatus main bodies is transmitted to the server via the apparatus main body and the communications network, and accumulated.

According to the invention, a plurality of apparatus main bodies are connected to the communications network, the operation information of the customer replaceable unit stored in the server is transmitted to the plurality of apparatus main bodies from the server via the communications network, and the customer replaceable units attached to the plurality of apparatuses and apparatus main bodies can operate in accordance with the same operation information. Moreover, operation performance information of the customer replaceable unit operated in accordance with the operation information stored in the main-body storing portion of each of the apparatus main bodies is transmitted to the server via the apparatus main body and the communications network, and accumulated. Therefore, it is possible to accurately grasp the respective use conditions of the customer replaceable units.

Still further, in the invention, it is preferable that a communication terminal of a dealer of the customer replaceable unit is connected to the communications network and, based on the operation performance information of the customer replaceable unit accumulated in the server, at least order information of the customer replaceable unit can be transmitted to the communication terminal of the dealer via the communications network.

According to the invention, the communication terminal of the dealer of the customer replaceable unit is connected to the communications network. For example, when the customer replaceable unit reaches the end of a use life thereof, based on the operation performance information of the customer replaceable unit accumulated in the server, order information of the customer replaceable unit is automatically transmitted from the server to the communication terminal of the dealer via the communications network. Consequently, the user of the apparatus does not need to place an order for a replacement article of the customer replaceable unit by himself/herself, with the result that it is possible to omit a troublesome ordering operation.

Still further, in the invention, it is preferable that at least the order information of the customer replaceable unit is displayed on a display portion of the apparatus main body and/or a display portion of the communication terminal connected to the communications network.

According to the invention, at least the order information of the customer replaceable unit is displayed on the display portion of the apparatus main body and/or the display portion of the communication terminal connected to the communications network. Therefore, the user of the apparatus can easily know that an order for a replacement article of the customer replaceable unit has been placed.

Still further, in the invention, it is preferable that the apparatus main body is a main body of an image forming apparatus.

According to the invention, the apparatus main body is a main body of an image forming apparatus. Therefore, as the customer replaceable unit disposed so as to be attachable to and detachable from the image forming apparatus, there are a variety of units such as a process cartridge, a toner cartridge, a transfer unit and a fixing unit, and it is possible to prevent leakage of the operation information useful for manufacture of such units and prevent manufacture of imitation products of the units.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
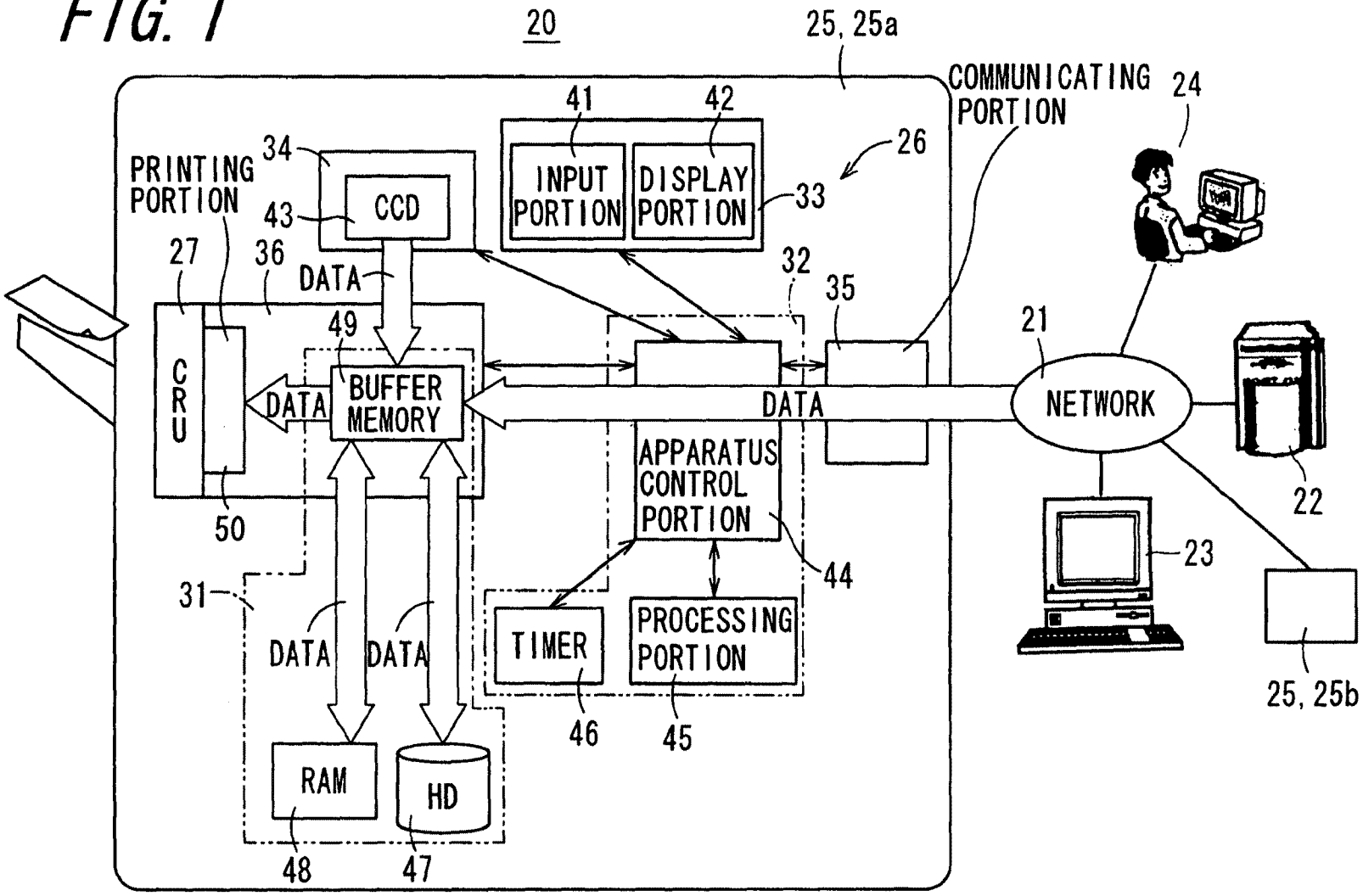
FIG. 1 is a system view illustrating the configuration of a network system comprising a customer replaceable unit according to an embodiment of the invention.

Now referring to the drawings, preferred embodiments of the invention are described below.

FIG. 1 is a system view illustrating the configuration of a network system comprising a customer replaceable unit 27 according to an embodiment of the invention. The embodiment illustrated in FIG. 1 provides a configuration that a multifunction printer (MFP) 25 in which the customer replaceable unit (CRU) 27 is attached to an apparatus main body 26 and used, is connected to a server 22 and a personal computer (PC) 23 serving as a communication terminal via, for example, in-office LAN, and that the LAN is further connected to a network 21 that is a wide area network such as the Internet.

A network system 20 comprising a customer replaceable unit (simply referred to as the network system 20 hereafter) comprises the apparatus main body 26 of the MFP 25, the apparatus main body having a main-body storing portion 31 that is information storing means and a control portion 32 that is operation controlling means; the CRU 27 disposed so as to be attachable to and detachable from the apparatus main body 26; the network 21 connected to the apparatus main body 26; the server 22 that is connected to the network 21 and stores operation information of the CRU 27; and the PC 23 and a communication terminal 24 of a dealer of the CRU 27, which are connected to the network 21. An apparatus illustrated here is the multifunction printer (MFP) 25 that serves as a copier, a printer, a scanner, a facsimile machine and so on as described before. The apparatus main body 26 of the MFP 25 is provided with not only the main-body storing portion 31 and the control portion 32 but also an operating portion 33, an image reading portion 34, a main-body communicating portion 35, an image forming portion 36 and so on.

The operating portion 33 includes an input portion 41 and a display portion 42. The input portion 41 is a portion for inputting an operation command in the case of operating the MFP 25 from the apparatus main body 26. For example, it is possible to input an operation command by operating various kinds of keys. The display portion 42 is, for example, a display panel realized by a liquid crystal display (LCD) or the like, and can display an operation command input from the input portion 41, an operation command by the control portion 42 and the like so that the operator can recognize.

The image reading portion 34 is a portion that reads image information of a document used in a case where the MFP 25 operates as a copier, a facsimile machine or the like. In the present embodiment, the image reading portion is provided with a CCD image sensor 43 as image reading means (here, CCD is the abbreviation of "charge coupled device"). Image information read by the image reading portion 34 is stored into a buffer memory 49 used for temporary storage of information, of the main-body storing portion 31.

The main-body communicating portion 35 is a portion that executes transfer of signals with the network 21 and a unit communicating portion 51 of the CRU 27 described later. The main-body communicating portion 35 may be configured so as to communicate by wireless, or may be configured so as to communicate through wire. In the present embodiment, the main-body communicating portion is configured so as to communicate by wireless, and configured so as to include a receiving/transmitting portion and an antenna. In a case where the MFP 25 functions as a printer, for example, image information created and transmitted by the PC 23 connected to the network 21 is received by the main-body communicating portion 35 via the network 21, and stored into the buffer memory 49 of the main-body storing portion 31 by an apparatus control portion 44.

The control portion 32 is a processing circuit having a central processing unit (CPU) and, in the present embodiment, includes the apparatus control portion 44, a processing portion 45 and a timer 46. The apparatus control portion 44 is a processing circuit that executes total control of image formation operations of the MFP 25. Moreover, when a main switch of the MFP 25 is turns on, the apparatus control portion obtains the operation information of the CRU 27 stored in the server 22, via the network 21. Furthermore, timing to obtain the operation information is not limited to the operation of the main switch of the apparatus main body 26, and may be set to each reception of an operation command to execute image formation by the apparatus main body 26 in the standby state.

The processing portion 45 forms the information erasing means for erasing the operation information of the CRU 27 stored in the buffer memory 49 of the main-body storing portion 31 when the end of communication between the main-body communicating portion 35 and the unit communicating portion 51 of the CRU 27 is received. When the apparatus control portion 44 detects a halt of communication between the main-body communicating portion 35 and the unit communicating portion 51 of the CRU 27, for example, detects a signal indicating that a series of image forming operations end and the main switch of the apparatus main body 26 is off, the processing portion 45 serving as the information erasing means erases the operation information stored in the buffer memory 49 based on an operation command from the apparatus control portion 44. Accordingly, the apparatus control portion 44 also operates as the communication end detecting portion.

Detection of a halt of communication between the main-body communicating portion 35 and the unit communicating portion 51 of the CRU 27 is not limited to detection that the main switch of the apparatus main body 26 is off, and may be detection by the apparatus control portion 44 that the MFP 25 is brought into the standby state. In this case, however, the operation information of the CRU 27 is obtained from the server 22 in response to the next command to execute an image forming operation input in the aforementioned standby state.

The timer 46 is timing means. The timer can start and stop timing in response to an operation designated by the apparatus control portion 44, and can reset the result of timing.

The main-body storing portion 31 of the present embodiment includes a hard disk drive (HD) 47 that stores, for example, a total operation program of the MFP 25, a random access memory (RAM) 48, and the buffer memory 49 that is a memory for temporarily storing information. When image formation is executed by the image forming portion 36, obtained image information is stored into the buffer memory 49 one after another, the apparatus control portion 44 reads out the image information stored in the buffer memory 49 one after another, and outputs an operation command to the image forming portion 36, whereby image formation is executed.

Figure 5:
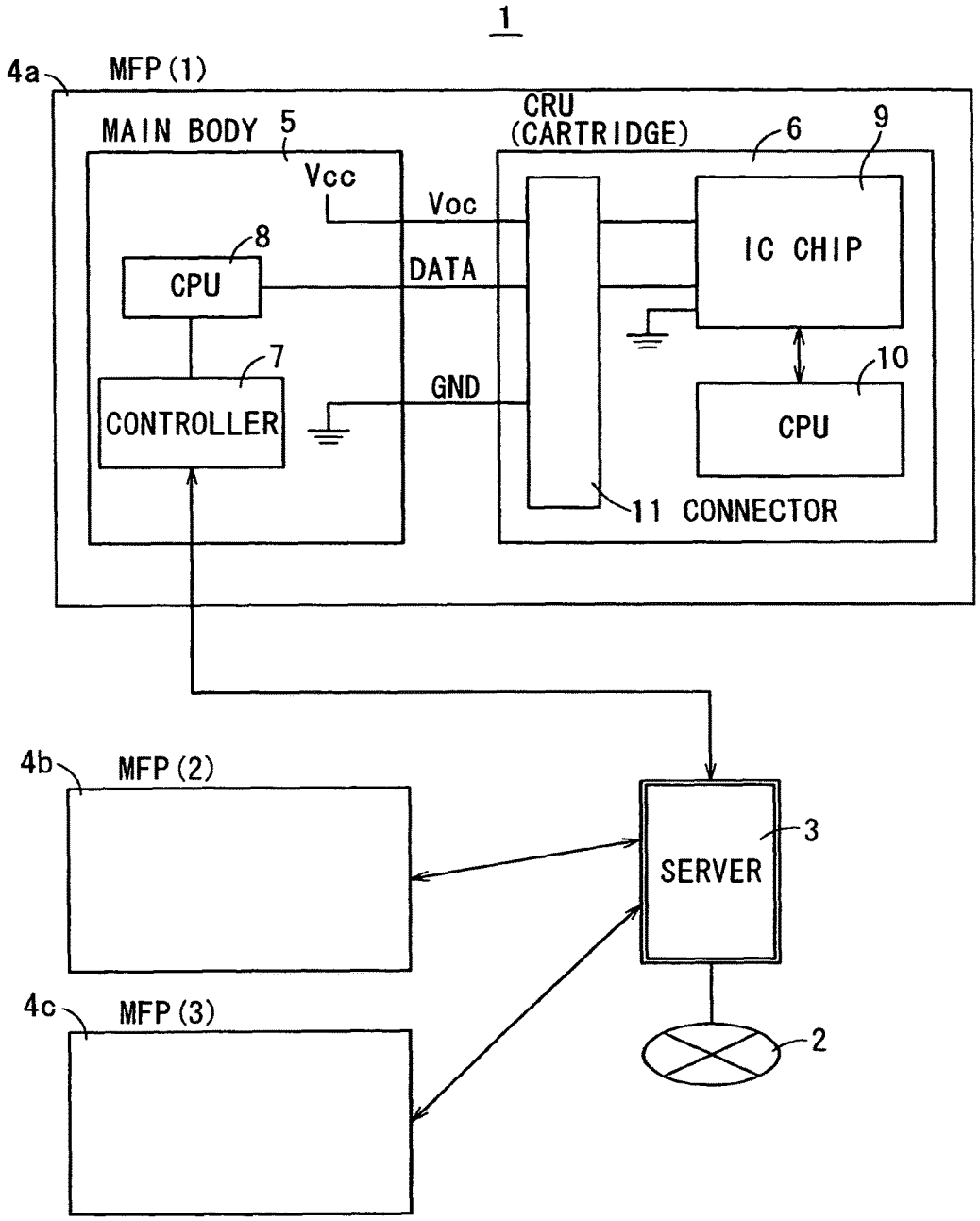
FIG. 5 PRIOR ART
FIG. 5 is a simplified system view illustrating the configuration of a network system comprising a conventional CRU.

Although the image forming portion 36 is represented by a printing portion 50, the image forming portion includes an electrophotographic photoconductor, a charger, an exposing device, a developing device, a transfer device, a cleaning device, a fixing device and so on. The present embodiment illustrates an example that the CRU 27 is a unit attached to the developing device so as to be freely attached and detached and is a toner cartridge for supplying toner that is a developer component to a developing portion of the developing device in a like manner as illustrated in FIG. 5 mentioned before.

Figure 2:
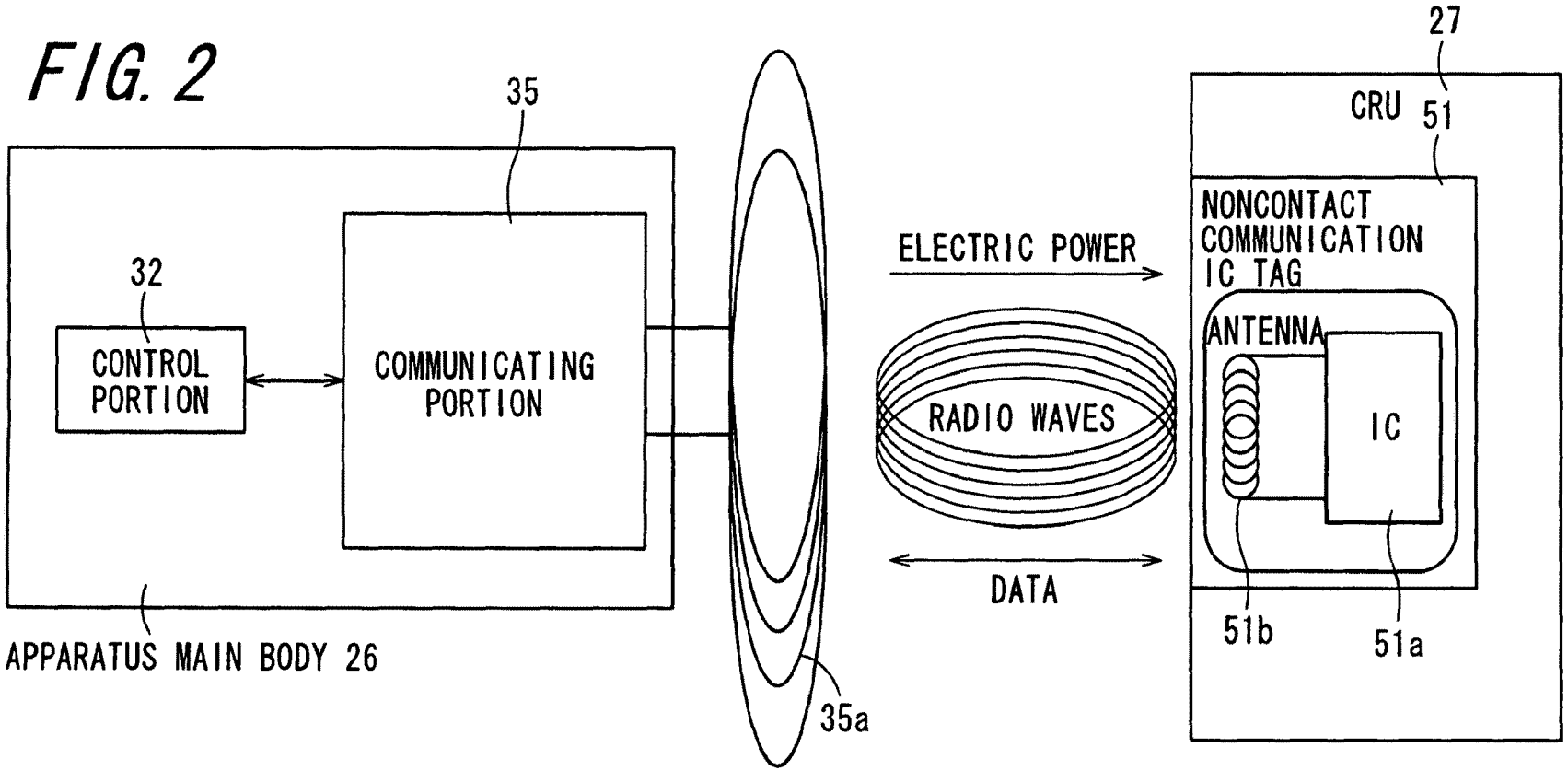
FIG. 2 is a view illustrating the outline of communication between a CRU and an apparatus main body.

FIG. 2 is a view illustrating the outline of communication between the CRU 27 and the apparatus main body 26. The CRU 27 comprises the unit communicating portion 51 that communicates with the main-body communicating portion 35 of the apparatus main body 26. In the present embodiment, the unit communicating portion 51 of the CRU 27 is formed by an IC tag. The IC tag 51 that is the unit communicating portion has a chip portion 51*a* and an antenna portion 51*b*. The chip portion 51*a* forms a CRUM capable of storing information. In the invention, information stored in the chip portion 51*a* in advance is limited to an identification code for identifying a toner cartridge that is the CRU 27, for example, a product number or the like, and operation information such as an operation program and a threshold value relating to an operation condition are not contained. However, operation performance of the CRU 27, for example, operation performance such as the number of rotations of a toner supply roller, which is information making it possible to calculate the amount of remaining toner held in a toner supply container of the toner cartridge can be stored in the chip portion 51*a*. Such operation performance information stored in the chip portion 51*a* is transferred by wireless communication between the CRU and the apparatus main body 26 via the antenna 51*b* of the IC tag 51 and an antenna 35*a* of the main-body communicating portion 35.

In the network system 20 of the invention, the operation information of the CRU 27 is not stored in the chip portion 51*a* forming the CRUM, but stored in the server 22 connected to the network 21. For example, when the main switch is turned on, in accordance with the total operation program, the apparatus control portion 44 of the apparatus main body 26 obtains the operation information of the CRU 27 from the server 22 via the network 21, and stores into the buffer memory 49 of the main-body storing portion 31. Based on the operation information of the CRU 27 stored in the buffer memory 49, the apparatus control portion 44 transmits an operation command by wireless communication between the main-body communicating portion 35 and the unit communicating portion 51 of the CRU 27, and causes the toner cartridge that is the CRU 27 to execute a toner supply operation. Wireless communication between the main-body communicating portion 35 and the unit communicating portion 51 is not limited to use of the IC tag 51. Infrared communication may be used, or a μ-Chip ® may be used.

Toner is supplied by the rotation of the toner supply roller provided in the toner supply container. Since an amount of toner supplied during one rotation of the toner supply roller is determined depending on the toner supply roller, it is possible to calculate an amount of remaining toner in the toner cartridge from the initial amount of toner held in the toner cartridge and the number of rotations of the toner supply roller after the toner cartridge is newly attached to the apparatus main body 26.

The number of rotations of the toner supply roller is stored as the operation performance of the CRU 27 into the chip portion 51*a* of the IC tag 51, and then sent from the antenna 51*b* to the main-body communicating portion 35. The operation performance received by the main-body communicating portion 35 is sent to the server 22 via the network 21 in accordance with an operation command of the apparatus control portion 44.

The operation performance sent to the server 22 is accumulated in the server 22. Moreover, in the server 22, two threshold values including first and second threshold values are stored as the operation information of the cartridge that is the CRU 27, by models of toner cartridges. In the server 22, the amount of remaining toner held in the toner supply container is calculated from the accumulated operation performance, namely, the number of rotations of the toner supply roller, and it is determined whether the operation performance has reached the first and second threshold values or not.

The first threshold value is set to an amount that there remains enough toner to be supplied to the developing portion of the developing device but it is desirable that a replacement article of the toner cartridge is prepared, and the first threshold value is referred to as a toner near end. Moreover, at the second threshold value, the toner in the toner supply container is exhausted, and it is impossible to supply toner to the developing portion. The second threshold value is referred to as a toner end.

When calculating the amount of remaining toner held in the toner supply container from the accumulated operation performance and determining that the operation performance reaches the first threshold value (the toner near end), the server 22 sends order information to the communication terminal 24 of the dealer via the network 21. The order information contains the model of the toner cartridge, order quantity, a desired deadline for delivery and a delivery place. Moreover, the server 22 sends the order information to the apparatus main body 26 and/or the PC 23 via the network 21, as well as to the communication terminal 24 of the dealer. The apparatus control portion 44 of the apparatus main body 26 having received the order information outputs an operation command to the display portion 42, thereby causing the display portion to display the order information. The PC 23 having received the order information causes a display portion thereof to display the order information.

When a series of image forming operations in the MFP 25 end and the apparatus control portion 44 serving as the communication end detecting portion detects the end of communication between the main-body communicating portion 35 and the unit communicating portion 51, the processing portion 45 serving as the information erasing means erases the operation information of the CRU 27 stored in the buffer memory 49, in accordance with the detection result. Thus, it is possible to obtain the operation information from the server 22 and store into the buffer memory 49 only when causing the CRU 27 to operate, and erase the operation information from the buffer memory 49 so that the operation information does not remain in either the CRU 27 or the apparatus main body 26 when the CRU ends operation. Therefore, it is impossible to elicit the operation information from the CRU 27, and it is possible to prevent manufacture of an imitation product using the operation information.

Although one MFP 25 (25*a*) connected to the network 21 is described in the above embodiment, the number of the apparatus main bodies 26 of the MFPs 25 connected to the network 21 is not limited to one, and may be plural. For example, two MFPs 25*a* and 25*b* may be connected to the network 21 in the network system 20 illustrated in FIG. 1.

The operation information of the CRU 27 stored in the server 22 is transmitted from the server 22 to the apparatus main bodies 26 of the two MFPs 25*a* and 25*b* via the network 21. The operation information transmitted to each of the apparatus main bodies 26 is stored into the buffer memory 49, and the CRU 27 attached to each of the MFPs 25*a* and 25*b* operates based on the operation information. Moreover, the operation performance information of each of the CRUs 27 is transmitted to the server 22 via the apparatus main body 26 and the network 21, and accumulated. Thus, the CRUs 27 attached to the apparatus main bodies 26 of a plurality of (in the present embodiment, two) MFPs can operate in accordance with one operation information. Moreover, since the operation performance information of each of the CRUs 27 operated in accordance with the operation information stored in the buffer memory 49 of each of the apparatus main bodies 26 is transmitted to the server 22 via the apparatus main body 26 and the network 21, and accumulated, it is possible to accurately grasp the respective use conditions of the CRUs 27.

Figure 3:
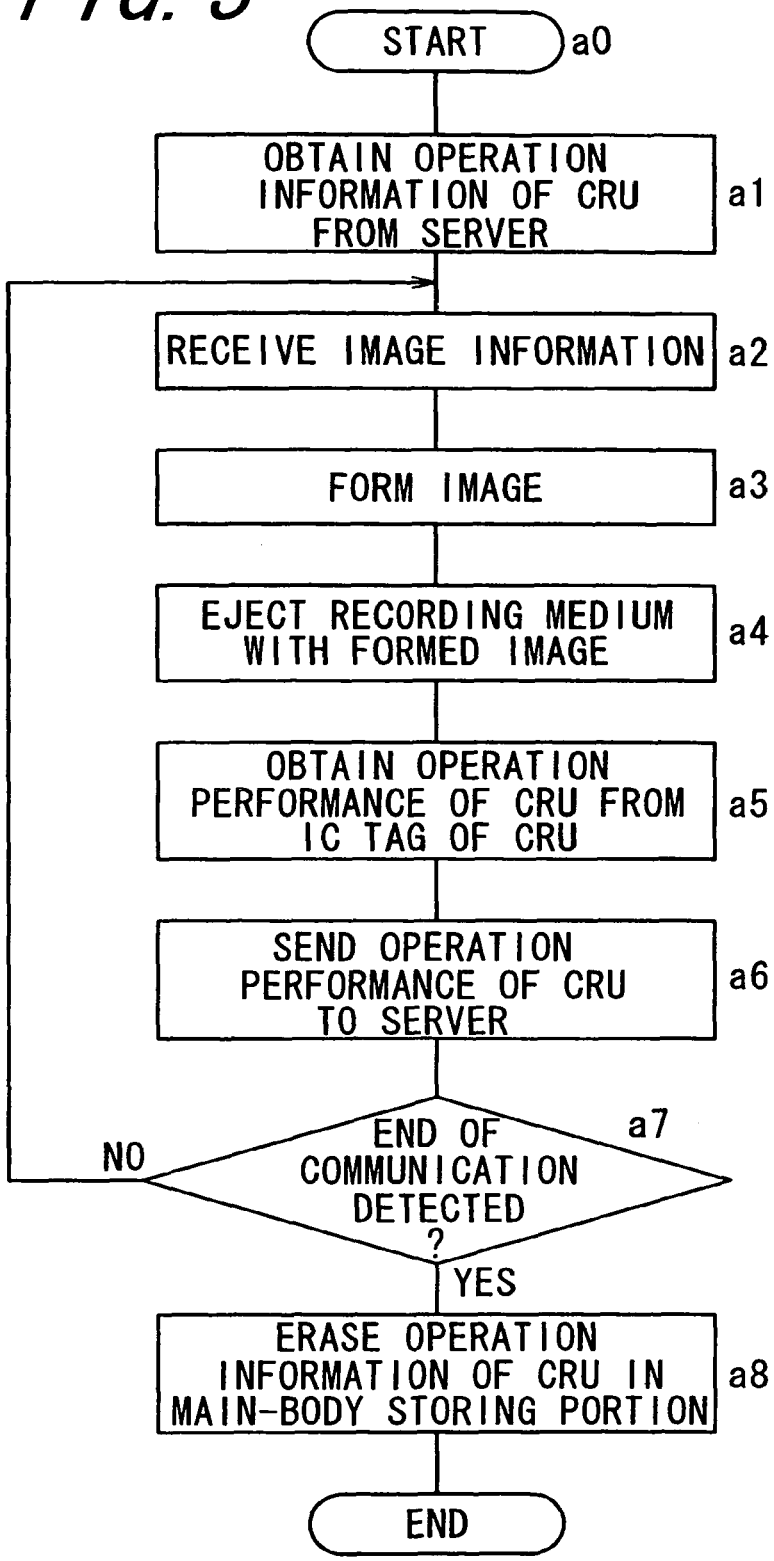
FIG. 3 is a flowchart describing the operation of the apparatus main body of an MFP in the network system.

FIG. 3 is a flowchart describing the operation of the apparatus main body 26 of the MFP 25 in the network system 20. With reference to FIG. 3, the operation of the apparatus main body 26 of the MFP 25 will be described.

At the start at step a0, the main switch of the apparatus main body 26 has been turned on, and initialization of the MFP 25 has been executed. At step a1, the operation information of the CRU 27 is obtained from the server 22 via the network 21 by an operation command of the apparatus control portion 44 of the apparatus main body 26.

At step a2, image information is received. The image information may be, for example, image information read from a document by the image reading portion 34, or image information created by the PC 23 serving as a communication terminal and sent from the PC 23 to the MFP 25 via the network 21 by a printing command of the PC 23. At step a3, a recording image is formed on a recording medium, for example, recording paper in the image forming portion 36. At step a4, the recording paper with the formed recording image is ejected to a paper ejecting tray or the like. At step a5, the apparatus main body 26 obtains (receives) the operation performance of the CRU 27 from the IC tag 51 that is the unit communicating portion of the CRU 27. At step a6, the apparatus main body sends the obtained operation performance of the CRU 27 to the server 22 via the network 21.

At step a7, it is determined whether the end of communication between the apparatus main body 26 and the CRU 27 is detected or not. In this operation flow, it is regarded as the end of the communication that a series of image forming operations end and the main switch of the apparatus main body 26 is turned off. When the end of the communication is not detected, for example, when the next image forming command is received, the operation returns to step a2 to execute the following steps. On the other hand, when the end of the communication is detected, the operation goes to step a8. At step a8, the processing portion 45 erases the operation information of the CRU 27 stored in the buffer memory 49 of the main-body storing portion 31, whereby the image forming operations end. The erasing operation of the processing portion 45 after it is detected that the main switch of the apparatus main body 26 is off, can be executed with electric power of, for example, a secondary battery provided in the apparatus main body 26.

Figure 4:
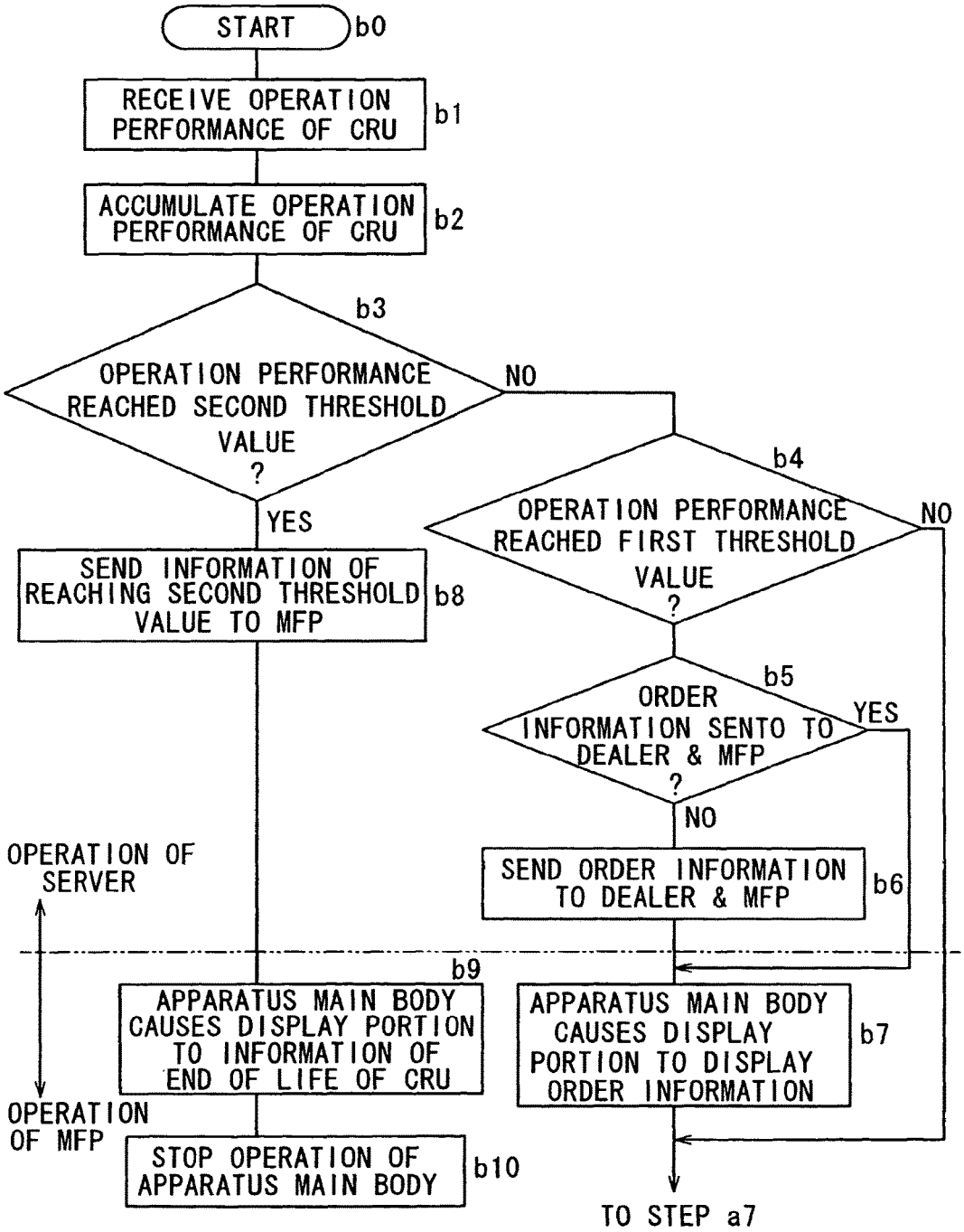
FIG. 4 is a flowchart describing the operation of a server having received operation performance of the CRU.

FIG. 4 is a flowchart describing the operation of the server 22 having received the operation performance of the CRU 27. With reference to FIG. 4, the operation of the server 22 having received the operation performance of the CRU 27 will be described below.

At the start at step b0, the operation performance of the CRU 27 has been sent to the server 22 from the MFP 25 via the network 21 at step a6 illustrated in FIG. 3. At step b1, the server 22 receives the operation performance of the CRU 27. Here, the CRU 27 is a toner cartridge, and the operation performance is, for example, the number of rotations of a toner supply roller from which the amount of remaining toner in a toner supply container can be obtained. At step b2, the operation performance of the CRU 27 is accumulated.

At step b3, it is determined whether the operation performance has reached the second threshold value or not. Here, reaching the second threshold value of the operation performance means that the toner held in the toner supply container of the toner cartridge is exhausted, that is, the toner cartridge has reached the toner end. The operation goes to step b4 when the toner cartridge has not reached the toner end yet, whereas the operation goes to step b8 when the toner cartridge has reached the toner end.

At first, a flow from step b4 where the toner cartridge has not reached the toner end yet will be described. At step b4, it is determined whether the operation performance has reached the first threshold value or not. Here, reaching the first threshold value of the operation performance means that the toner held in the toner supply container of the toner cartridge is running short, that is, the toner cartridge has reached the toner near end.

When the toner cartridge has not reached the toner near end, it is possible to continue to supply a sufficient amount of toner, that is, continue to execute image information without hindrance. Therefore, any operation command signal is not sent from the server 22 to the MFP 25, and the operation goes from step a6 to step a7 in the flowchart of the image forming operations of the MFP 25 illustrated in FIG. 3.

On the other hand, when the toner cartridge has reached the toner near end, the operation goes to step b5. At step b5, based on the toner near end state, it is determined whether or not the order information of the toner cartridge that is the CRU 27 has been sent to the communication terminal 24 of the dealer and the MFP 25. The operation goes to step b7 when the order information has been sent, whereas the operation goes to step b6 when the order information has not been sent. At step b6, the order information is sent to the communication terminal 24 of the dealer and the MFP 25 via the network 21.

Since the order information is sent to the MFP 25 as well, the apparatus main body 26 having received the order information causes the display portion 42 to display the order information at step b7. Since the operator of the MFP 25 can know by the display of the order information on the display portion 42 that a replacement article of the CRU 27 has been ordered, duplicate order is prevented, and it is possible to continue the operation of image formation. Moreover, the dealer having received the order information by the communication terminal 24 will deliver a replacement article of the CRU 27 by a designated delivery deadline, to a designated place. The order information of the CRU 27 may also be sent to the PC 23 giving an image forming operation command to the MFP 25, via the network 21, and displayed on a display screen of the PC 23.

When the operation performance has reached the second threshold value at step b3 described before and the operation goes to step b8, information that the operation performance has reached the second threshold value, that is, the toner cartridge has reached the toner end, is sent to the MFP 25 at step b8. When the toner cartridge that is the CRU 27 has reached the toner end, there is no toner to be supplied to the developing portion of the developing device, with the result that a developed image may be lack of density. Therefore, when the information of the toner end is sent from the server 22 to the MFP 25, the MFP 25 temporarily stops advancement from step a6 to step a7 in the flowchart illustrated in FIG. 3 described before, and executes operations from step b9 illustrated in FIG. 4. At step b9, the apparatus main body 26 having received the toner end information causes the display portion 42 to display the information of the toner end, that is, the end of life of the CRU 27, and the operation goes to step b10, where the image forming operations of the apparatus main body 26 is stopped.

After the operator recognizes the display of the toner end, and replaces the toner cartridge that is the CRU 27 with a replacement article, the apparatus main body can execute the operations from step a7 in the image forming operation illustrated in the flowchart of FIG. 3.

As described above, in the present embodiment, the apparatus is an image forming apparatus. However, the apparatus is not limited to the above one, and may be another one as far as the apparatus is equipped with a customer replaceable unit (CRU). Moreover, the apparatus is an image forming apparatus, and the CRU is a toner cartridge. However, the CRU is not limited to the above one, and may be a process cartridge, a transfer unit, a fixing unit or the like.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A server comprising:

an accumulation portion configured to accumulate an operation performance for calculating an amount of remaining toner held in a toner supply container of a developing device attached to an image forming apparatus;

a calculation portion configured to calculate the amount of remaining toner held in the toner supply container based on the operation performance accumulated by the accumulation portion;

a determination portion configured to determine whether the amount of remaining toner reaches a threshold; and a sending portion configured to send order information when it is determined that the amount of remaining toner reaches the threshold.

2. The server according to the claim 1, wherein the threshold value is determined according to models of toner cartridges.

3. A system comprising:

an accumulation portion configured to accumulate an operation performance for calculating an amount of remaining toner held in a toner supply container of a developing device attached to an image forming apparatus;

a calculation portion configured to calculate the amount of remaining toner held in the toner supply container based on the operation performance accumulated by the accumulation portion;

a determination portion configured to determine whether the amount of remaining toner reaches a threshold; and a sending portion configured to send order information when it is determined that the amount of remaining toner reaches the threshold.

4. The system according to the claim 3, wherein the threshold value is determined according to models of toner cartridges.

* * * * *